US008941503B1

(12) United States Patent
Hobson

(10) Patent No.: US 8,941,503 B1
(45) Date of Patent: Jan. 27, 2015

(54) WATER SAVING ALARM FOR USE WITH A TOILET TANK

(76) Inventor: Ted G. Hobson, Winston Salem, NC (US)

( * ) Notice: Subject to any disclaimer, the term of this patent is extended or adjusted under 35 U.S.C. 154(b) by 385 days.

(21) Appl. No.: 13/443,018

(22) Filed: Apr. 10, 2012

(51) Int. Cl.
*G08B 21/00* (2006.01)

(52) U.S. Cl.
USPC ..... 340/612; 340/604; 340/618; 340/620

(58) Field of Classification Search
USPC ..... 4/213; 340/620, 604, 612, 618
See application file for complete search history.

(56) References Cited

U.S. PATENT DOCUMENTS

| | | | | |
|---|---|---|---|---|
| 4,547,768 | A * | 10/1985 | Kulhavy | 340/620 |
| 4,876,751 | A | 10/1989 | Van Meter | |
| 6,543,479 | B2 | 4/2003 | Coffey | |
| 6,671,893 | B1 | 1/2004 | Quintana | |
| 6,937,155 | B2 * | 8/2005 | Ballard | 340/573.1 |
| 7,000,627 | B1 | 2/2006 | Johnson | |
| 7,028,347 | B2 | 4/2006 | Sanderson | |
| 7,293,583 | B2 | 11/2007 | Arigoni | |
| 8,332,969 | B2 * | 12/2012 | Spadola et al. | 4/227.1 |
| 2003/0196258 | A1 * | 10/2003 | Pham et al. | 4/427 |
| 2005/0189275 | A1 * | 9/2005 | Stewart | 210/86 |
| 2006/0130221 | A1 * | 6/2006 | Bulala et al. | 4/227.1 |
| 2006/0168716 | A1 * | 8/2006 | Schuster et al. | 4/415 |
| 2006/0168717 | A1 * | 8/2006 | Schuster et al. | 4/415 |
| 2007/0157374 | A1 * | 7/2007 | Morris | 4/427 |
| 2009/0235441 | A1 * | 9/2009 | Spadola et al. | 4/213 |
| 2010/0101030 | A1 * | 4/2010 | Kim | 8/159 |

* cited by examiner

*Primary Examiner* — Jennifer Mehmood
*Assistant Examiner* — Rufus Point
(74) *Attorney, Agent, or Firm* — Kyle A. Fletcher, Esq.

(57) ABSTRACT

The water saving alarm for use with a toilet tank is an accessory that works in conjunction with an existing toilet to provide an audible alarm upon detection of a drop in water level inside of the toilet tank for a predetermined amount of time. The water saving alarm is solely capable of alerting an end user to a continuously running toilet in order for said end user to take corrective action with said toilet. The water saving alarm includes a housing that rests atop of the top, edge of the toilet tank, and from which an air pressure tube descends downwardly inside of the toilet tank in order to detect water level therein. The audible alarm is produced from a speaker located elsewhere on said housing.

13 Claims, 5 Drawing Sheets

WATER SAVING ALARM FOR USE WITH A TOILET TANK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of toilets, more specifically, an alarm for use with a toilet tank to prevent unintended waste of water.

Running toilets have long, been a problem, which is usually fixed by jiggling of the handle. Often, a running toilet can waste a large amount of water as the flapper valve does not properly reseat itself over the opening of the toilet tank. This is a problem that becomes ever more crucial where water shortages are becoming more prevalent. In such a situation, it is desirable to provide an audible alarm that attaches onto the toilet tank, and which generates an audible alarm to grab the attention of an end user, only if the water level in the toilet tank does not raise up to the desired water level after a predetermined amount of time.

The device of the present application seeks to address this need while providing an alarm that easily installs onto an existing toilet tank, and which can provide the audible alarm.

B. Discussion of the Prior Art

As will be discussed immediately below, no prior art discloses a water saving alarm for use with a toilet that includes a housing uniquely designed to rest atop of a top rim of a toilet tank, and from which an air pressure tube descends downwardly into said toilet tank; wherein the air pressure tube detects the water level inside of said toilet tank, and upon detecting pre-determined parameters shall emit an audible alarm; wherein the housing includes a speaker that emits said audible alarm as well as a reset button to reset the alarm as needed; wherein the alarm shall alert an end user to a continuously running toilet so as to enable said end user to timely address said issue with said toilet in order to prevent waste of fresh water from said continuously running toilet.

The Arigoni Patent (U.S. Pat. No. 7,293,583) discloses an electronically controlled electro-mechanical device designed to limit a finite amount of water per flush to a tank reservoir of the common household toilet. However, the device does not attach onto an existing toilet tank, and generate an audible alarm upon detection that the water level in the toilet tank has dropped below a predetermined level for a predetermined amount of time.

The Quintana et al. Patent (U.S. Pat. No. 6,671,893) discloses a battery powered toilet and urinal leak, overflow and stuck valve prevention system employing a butterfly valve, a reset button, and a timer. However, the stuck valve prevention system is not a device that attaches atop of a toilet tank as the stuck valve prevention system works down line from the valve, and does not generate an audible alarm as to the detection of a running toilet.

The Coffey Patent (U.S. Pat. No. 6,543,479) discloses a water monitoring and control system adapted for residential and commercial use that automatically shuts off the water supply after a predetermined amount of time. Again, the monitoring and control system does not attach onto an top, edge of a toilet tank, and detect a water level inside of said toilet tank, and thereafter generate an audible alarm indicating that the toilet is running and thus wasting fresh water.

The Johnson Patent (U.S. Pat. No. 7,000,627) discloses a toilet safety valve that ensures the flow of water to a toilet tank is shutoff that includes a timer mechanism that backs up a float mechanism. However, the toilet safety valve does not generate an audible alarm upon detection that the water level inside of the toilet tank has dropped below a predetermined level for a predetermined amount of time.

The Van Meter Patent (U.S. Pat. No. 4,876,751) discloses an automatic toilet flush control system with a timer actuated valve mechanism. Again, the automatic toilet flush control system is not an audible alarm generated upon detection that a water level inside of a toilet tank has dropped below a predetermined amount of time.

The Schuster et al. Patent Application Publication (U.S. Pub. No. 2006/0168716) discloses a system and method of controlling the flow of water from a fill valve in a toilet tank to a toilet bowl of a toilet. However, the system and method includes a valve to stop water flow, and which is located in line of the water line to the fill valve, and is not an audible alarm that is produced upon detection of a drop in water level for a predetermined amount of time.

The Sanderson Patent (U.S. Pat. No. 7,028,347) discloses a digital electronic volume/flow control sensor toilet includes a bowl, a water storage tank interconnected with the bowl, and a digital electronic volume/flow control sensor flushing mechanism. Again, the sensor controls the water flow inside of the toilet tank, and is not an audible alarm that detects and alerts an end user to a continuously running toilet.

While the above-described devices fulfill their respective and particular objects and requirements, they do not describe a water saving alarm for use with a toilet that includes a housing uniquely designed to rest atop of a top rim of a toilet tank, and from which an air pressure tube descends downwardly into said toilet tank; wherein the air pressure tube detects the water level inside of said toilet tank, and upon detecting pre-determined parameters shall emit an audible alarm; wherein the housing includes a speaker that emits said audible alarm as well as a reset button to reset the alarm as needed; wherein the alarm shall alert an end user to a continuously running toilet so as to enable said end user to timely address said issue with said toilet in order to prevent waste of fresh water from said continuously running toilet. In this regard, the water saving alarm for use with a toilet tank departs from the conventional concepts and designs of the prior art.

SUMMARY OF THE INVENTION

The water saving alarm for use with a toilet-tank is an accessory that works in conjunction with an existing toilet to provide an audible alarm upon detection of a drop in water level inside of the toilet tank for a predetermined amount of time. The water saving alarm is solely capable of alerting an end user to a continuously running toilet in order for said end user to take corrective action with said toilet. The water saving alarm includes a housing that rests atop of the top, edge of the toilet tank, and from which an air pressure tube descends downwardly inside of the toilet tank in order to detect water level therein. The audible alarm is produced from a speaker located elsewhere on said housing.

It is an object of the invention to provide an accessory that works with an existing toilet to detect the water level inside of said tank, and which produces an audible alarm upon detection of pre-determined parameters.

A further object of the invention is to provide an audible alarm that alerts an end user that the respective toilet has a continuously running refill valve, which is wasting freshwater, and thereby requires the end user's attention to fix said issue.

Another object of the invention is to provide an accessory that fits onto the top, edge of the toilet tank, and which can be installed on any toilet tank.

Another object of the invention is to provide a housing that is uniquely shaped to fit onto the top, edge of the toilet tank.

Another object of the invention is to provide a reset button that can be depressed once the running toilet issue has been fixed.

Another object of the invention is to provide a speaker on an outer surface of the housing, which can emit the audible alarm.

Another object of the invention is to provide an air pressure tube that descends downwardly from the housing, and inside of the toilet tank, and which detects the change in air pressure inside of the air pressure tube in order to monitor the water level inside of the toilet tank.

Another object of the invention is to enable the invention to provide an audible alarm for indicating a low battery signal, which notifies an end user to replace said battery(s).

These together with additional objects, features and advantages of the water saving alarm for use with a toilet tank will be readily apparent to those of ordinary skill in the art upon reading the following detailed description of presently preferred, but nonetheless illustrative, embodiments of the water saving alarm for use with a toilet tank when taken in conjunction with the accompanying drawings.

In this respect, before explaining the current embodiments of the water saving alarm for use with a toilet tank in detail, it is to be understood that the water saving alarm for use with a toilet tank is not limited in its applications to the details of construction and arrangements of the components set forth in the following description or illustration. Those skilled in the art will appreciate that the concept of this disclosure may be readily utilized as a basis for the design of other structures, methods, and systems for carrying out the several, purposes of the water saving alarm for use with a toilet tank.

It is therefore important that the claims be regarded as including such equivalent construction insofar as they do not depart from the spirit and scope of the water saving alarm for use with a toilet tank. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
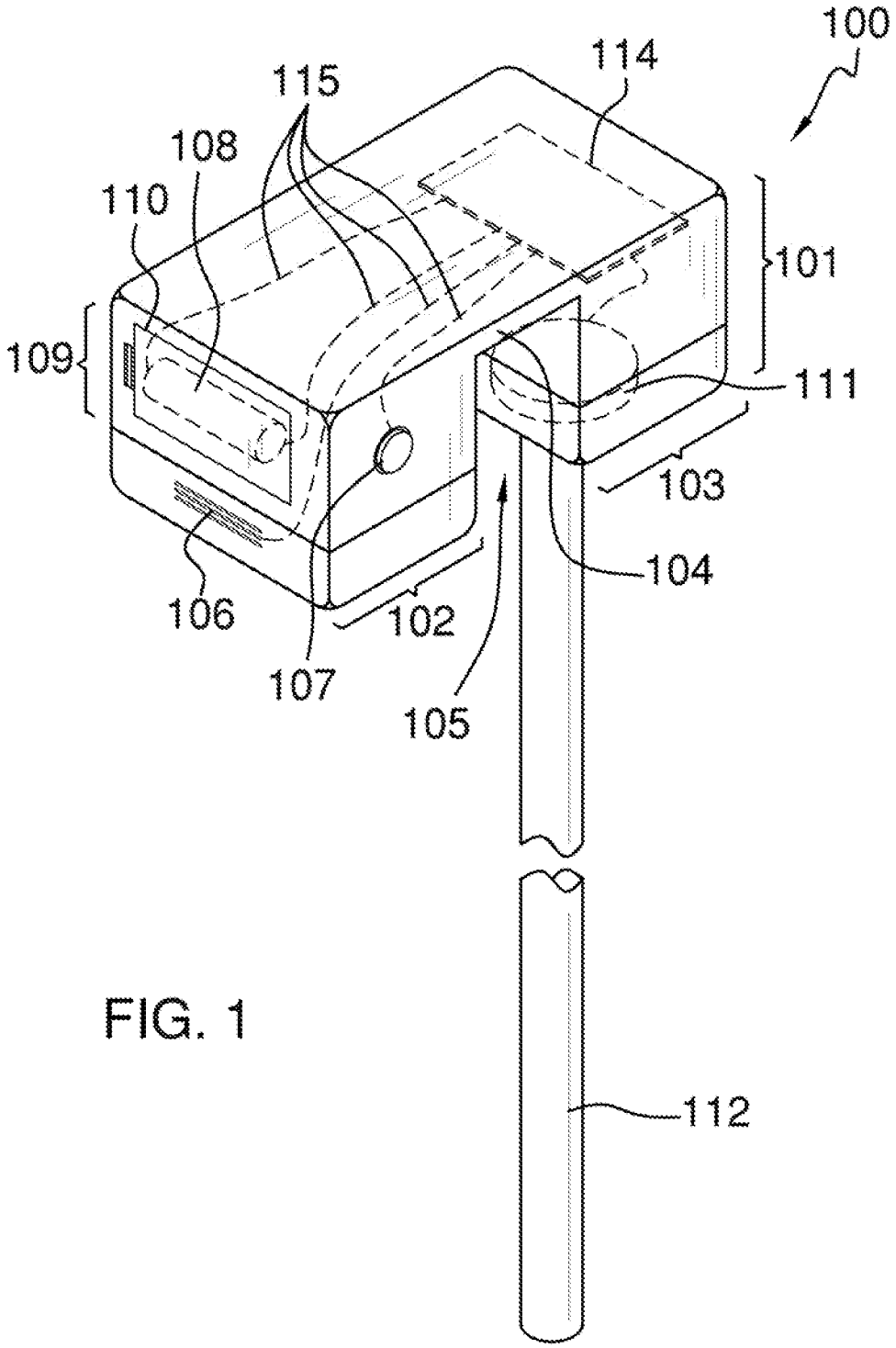
FIG. 1 illustrates a perspective view of the water saving alarm by itself, and detailing the shape of the housing as well as a battery located therein, and which is depicted in broken lines.
Figure 2:
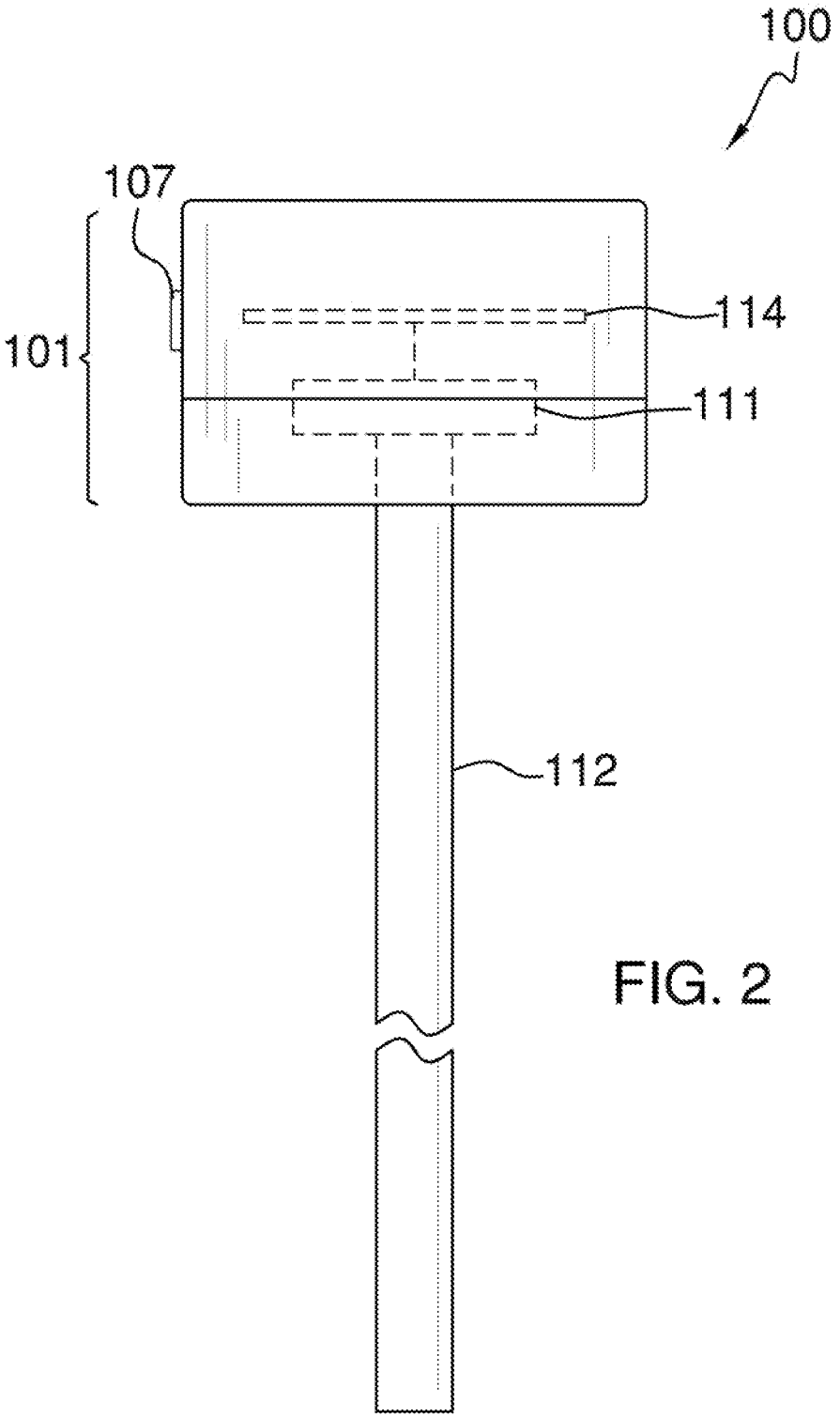
FIG. 2 illustrates an air pressure sensor located inside of the housing and in fluid communication with atop end of the air pressure tube.
Figure 3:
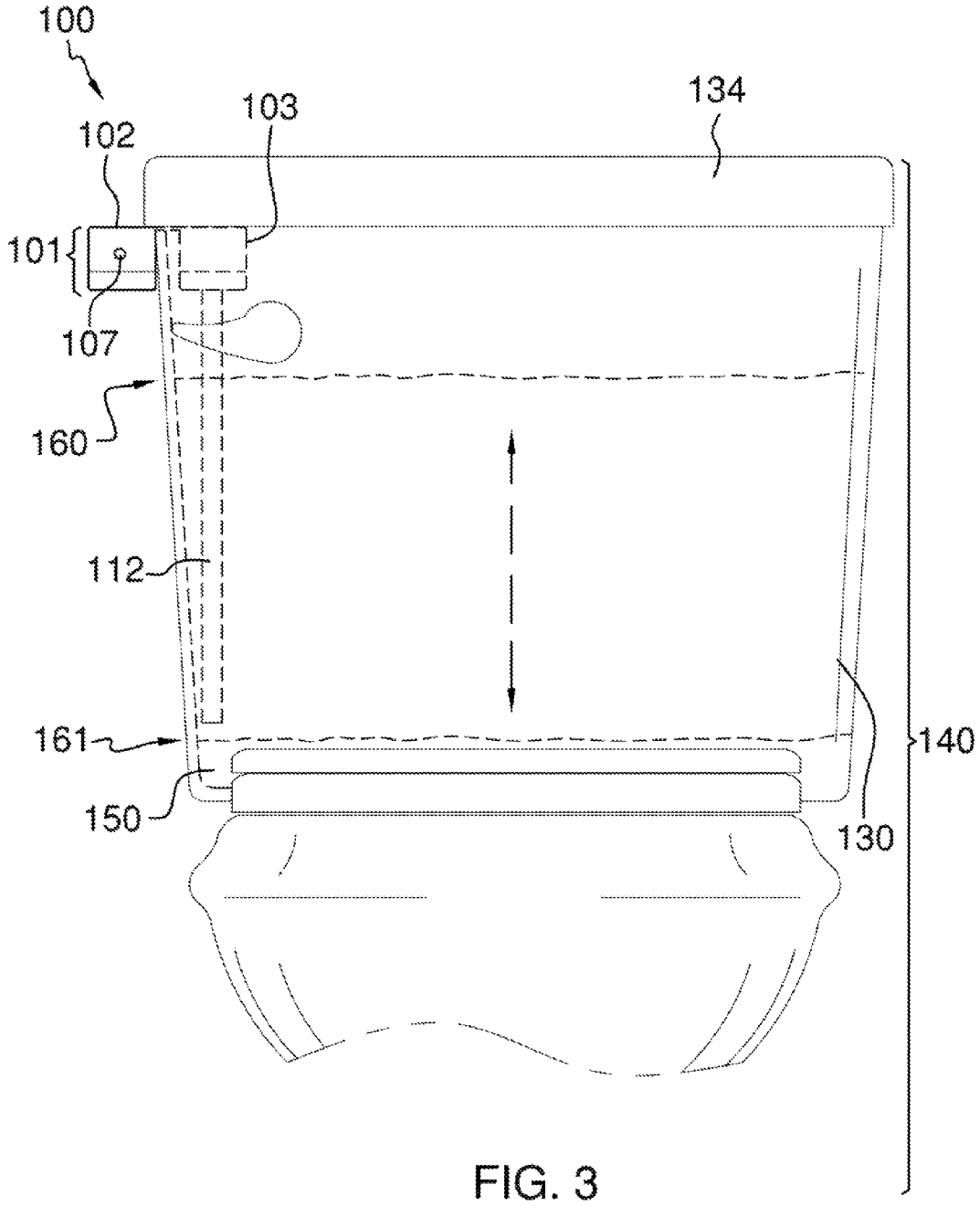
FIG. 3 illustrates a front view of the water saving alarm installed onto the toilet tank wherein the water level inside of the toilet tank is below that of the air pressure tube, which descends downwardly from the housing.
Figure 4:
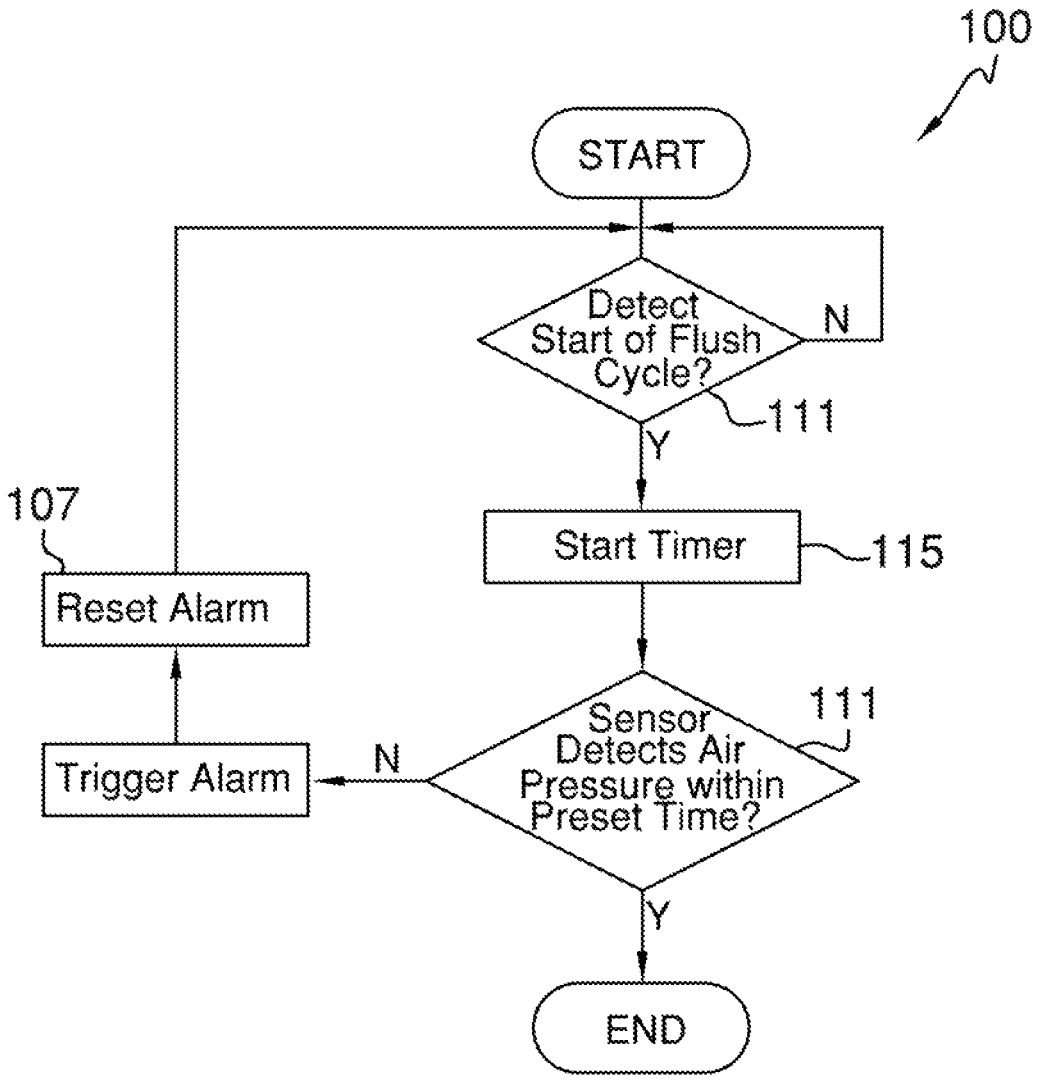
FIG. 4 illustrates a flow diagram of the water saving alarm.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A water saving alarm for use with a toilet tank 100 (hereinafter invention) includes a housing 101 that is comprised of a first housing member 102 and a second housing member 103 that are connected by a bridging member 104 such that a channel 105 is formed there between. The shape of the housing 101 is important to the overall application of the invention 100 with respect to a toilet tank 130.

Figure 5:
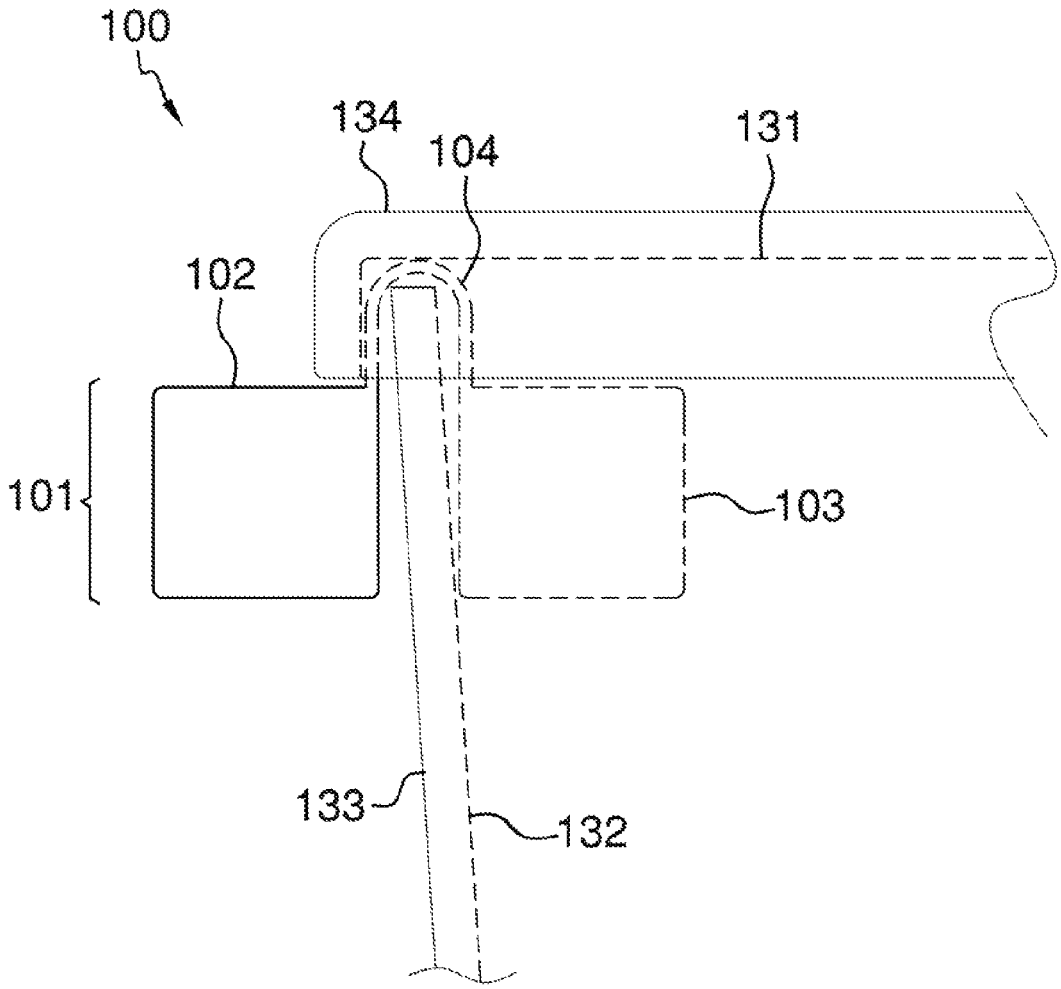
FIG. 5 illustrates another front view of the water saving alarm in which the housing has a different contour that enables the lid of the toilet tank to fit atop of the toilet tank.

The housing 101 is designed to rest on a top, edge 131 of the toilet tank 130 such that the channel 105 engages both an inner surface 132 as well as an outer surface 133 of the toilet tank 130. Referring to FIG. 5, the shape of the bridging member 104 may have a curvature that enables a toilet tank lid 134 to snuggly rest atop of the toilet tank 130 such that the invention 100 provides no interference.

The first housing member 102 is designed to rest outside of the toilet tank 130 whereas the second housing member 103 is designed to rest inside of the toilet tank 130. The first housing member 102 includes a speaker 106 on an external surface, which enables an audible alarm to be emitted there from. The first housing member 102 also includes a reset button 107, which when depressed shall reset the invention 100. The first housing member 102 also stores a powering means 108 therein, and which is further defined as a battery compartment 109. The battery compartment 109 may include a removable cover 110, which when removed provides access to the powering means 108 located therein. The powering means 108 may be in the form of at least one battery, which may be rechargeable.

As a side note, the bridging member 104 shall be of hollow construction so as to enable communication and interconnectively of components of the invention 100 located in either the first housing member 102 and the second housing member 103.

The second housing member 103 includes an air pressure sensor 111 therein, which is in fluid communication with an air pressure tube 112. The air pressure tube 112 is a tube of an undefined length, which extends downwardly from the second housing member 103. The air pressure tube 112 is designed to extend downwardly inside of the toilet tank 130, and detect a change in air pressure associated with the flushing of the toilet 140. Moreover, a water 150 inside of the toilet tank 130 shall drop upon flushing the toilet 140, and at which point produces a change in air pressure that is detected via the invention 100. It shall be noted that the toilet tank 130 shall have a filled water level 160, and a flushed water 161. The filled water level 160 is defined as the water level inside of the toilet tank at which point the refill valve stops water from entering the toilet tank 130, and is usually associated with a float reaching a pre-determined level inside of the toilet tank 130. The flushed water level 161 shall be defined as the level of water remaining once the water inside of the toilet tank 130 has been used to flush the toilet 140, and which is a minimal amount.

A central processing unit 114 (hereinafter CPU) is included inside of the housing 101, and is in communication with the air pressure sensor 111. Moreover, the CPU 114 monitors the air pressure sensor 111, and includes a timer 115 that begins once the air pressure sensor 111 detects the flushed water level 161. The timer 115 shall run until the air pressure sensor 111 signals the CPU 114 to the detection of a filled water level 160, which shall be attributed to the air pressure sensor 111 sensing an increase in air pressure. The CPU 114 shall generate the audible alarm via the speaker 106 if the air pressure sensor 111 does not detect the filled water level 160 after a predetermined amount of time has elapsed, and which is reflective of a failure of the air pressure sensor 111 in sensing an increase in air pressure due to rising water inside of the toilet tank 130.

It shall be noted that the reset button 107 will only work to reset the CPU 114 if the filled water level 160 is detected via the air pressure sensor 111. Referring to FIG. 1, wiring 115 connects the CPU 114 to the air pressure sensor 11, the powering means 108, the speaker 106, and the reset button 107. Moreover, the wiring 115 is further evidence of the interconnectivity and communication of the various components located in either the first housing member 102 and the second housing member 103.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A water saving alarm for use with a toilet tank comprising:

a housing adapted to rest atop a toilet tank and from which an air pressure tube adaptively extends downwardly inside of said toilet tank to detect a water level inside of said toilet tank, and upon detection of a flushed water level shall start a timer, which shall count out for a predetermined amount of time, after which an audible alarm is emitted to alert to the presence of a toilet tank that is not refilling with freshwater, and which is wasting of said freshwater;

wherein the housing is comprised of a first housing member and a second housing member that are connected by a bridging member such that a channel is formed there between;

wherein the housing rests on a top, edge of the toilet tank such that the channel straddles between both an inner surface as well as an outer surface of the toilet tank;

wherein the bridging member includes a curvature that enables a toilet tank lid to snuggly rest atop of the toilet tank;

wherein the first housing member rests outside of the toilet tank whereas the second housing member rests inside of the toilet tank.

2. The water saving alarm for use with a toilet tank as described in claim 1 wherein the first housing member includes a speaker on an external surface, which emits said audible alarm there from.

3. The water saving alarm for use with a toilet tank as described in claim 2 wherein the first housing member also includes a reset button, which when depressed shall reset the timer provided the water level inside of the toilet tank has returned to a filled water level.

4. The water saving alarm for use with a toilet tank as described in claim 3 wherein the first housing member also stores a powering means therein, and which is further defined as a battery compartment including a removable cover, which when removed provides access to the powering means located therein.

5. The water saving alarm for use with a toilet tank as described in claim 4 wherein the powering means is comprised of at least one battery.

6. The water saving alarm for use with a toilet tank as described in claim 1 wherein the bridging member is of hollow construction so as to enable communication and interconnectivity between the first housing member and the second housing member.

7. The water saving alarm for use with a toilet tank as described in claim 3 wherein the air pressure tube is in fluid communication with an air pressure sensor located inside of the second housing member, and which is in wired communication with a central processing unit; wherein the central processing unit is in wired communication with the speaker, and which produces the alarm, and controls the timer.

8. A water saving alarm for use with a toilet tank comprising:

a housing that is adapted to rest atop a toilet tank and from which an air pressure tube adaptively extends downwardly inside of said toilet tank to detect a water level inside of said toilet tank;

wherein the air pressure tube signals to an air pressure sensor a change from a filled water level to a flushed water level, and upon detection of said flushed water level shall start a timer, which shall count out for a predetermined amount of time, after which an audible alarm is emitted to alert to the presence of a toilet tank that is not refilling with freshwater, and which is wasting of said freshwater;

wherein the housing is comprised of a first housing member and a second housing member that are connected by a bridging member such that a channel is formed there between; wherein the housing rests on a top, edge of the toilet tank such that the channel straddles between both an inner surface as well as an outer surface of the toilet tank; wherein the bridging member is of hollow construction so as to enable communication and interconnectivity between the first housing member and the second housing member;

wherein the bridging member includes a curvature that enables a toilet tank lid to snuggly rest atop of the toilet tank;

wherein the first housing member rests outside of the toilet tank whereas the second housing member rests inside of the toilet tank.

9. The water saving alarm for use with a toilet tank as described in claim 8 wherein the first housing member includes a speaker on an external surface, which emits said audible alarm there from.

10. The water saving alarm for use with a toilet tank as described in claim 9 wherein the first housing member also includes a reset button, which when depressed shall reset the timer provided the water level inside of the toilet tank has returned to a filled water level.

11. The water saving alarm for use with a toilet tank as described in claim 10 wherein the first housing member also stores a powering means therein, and which is further defined as a battery compartment including a removable cover, which when removed provides access to the powering means located therein.

12. The water saving alarm for use with a toilet tank as described in claim 11 wherein the powering means is comprised of at least one battery.

13. The water saving alarm for use with a toilet tank as described in claim 10 wherein the air pressure tube is in fluid communication with an air pressure sensor located inside of the second housing member, and which is in wired communication with a central processing unit; wherein the central processing unit is in wired communication with the speaker, and which produces the alarm, and controls the timer.

* * * * *